US006553205B1

(12) United States Patent
Liu

(10) Patent No.: US 6,553,205 B1
(45) Date of Patent: Apr. 22, 2003

(54) SYSTEM FOR TONER CLEANING

(75) Inventor: Chu-heng Liu, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/014,571

(22) Filed: Dec. 14, 2001

(51) Int. Cl.[7] ..... G03G 21/00
(52) U.S. Cl. ..... 399/348
(58) Field of Search ..... 399/348, 357, 399/343, 249

(56) References Cited

U.S. PATENT DOCUMENTS 3,744,452 A * 7/1973 Savit et al. ..... 399/249
4,263,391 A * 4/1981 Saito et al. ..... 399/348
4,325,627 A * 4/1982 Swidler et al. ..... 399/249
4,547,063 A * 10/1985 Stange
5,121,167 A 6/1992 Gundlach
5,526,028 A 6/1996 Rottman ..... 347/23
5,937,249 A * 8/1999 Shin ..... 399/249
6,002,899 A * 12/1999 Stover et al. ..... 399/249
6,256,468 B1 7/2001 Liu ..... 399/237

* cited by examiner

*Primary Examiner*—Susan S. Y. Lee
(74) *Attorney, Agent, or Firm*—Mark Z. Dudley

(57) ABSTRACT

A toner cleaning system for cleaning a toner from a supporting surface, including a movable member having a carrier permeable segment that features a porous structure. The movable member is actuated to engage the supporting surface so as to receive therefrom the toner at an exterior surface of the carrier permeable segment. A quantity of carrier fluid is provided at an interior surface of the carrier permeable segment. The carrier permeable segment supports carrier fluid flow from the interior surface to a portion of the received toner so as to disengage the portion of the received toner from the carrier permeable segment. The disengaged toner portion is then susceptible to collection and re-use. Embodiments of the toner cleaning system are operable in an imaging system for effecting electrostatic printing of an image, wherein the imaging system includes at least one contact electrostatic printing engine operable for imaging and development of a latent image representative of the image, and subsequent transfer of the developed image to a copy substrate.

22 Claims, 6 Drawing Sheets

SYSTEM FOR TONER CLEANING

This invention relates generally to electrostatic latent image development systems that develop images with use of marking particles provided in a developing material, and, more particularly, relates to systems for electrostatic development of a latent image, wherein marking particles are cleaned from a supporting surface.

Various methods of toner cleaning have been described in the art of electrostatographic printing and copying systems. A typical electrostatographic printing process includes a development step whereby a quantity of developing material is physically transported into the vicinity of an imaging member bearing a latent image. Marking materials (known as marking particles, toner particles, or toner) in the developing material are caused to migrate via, e.g., electrical attraction, to the image areas of the latent image so as to selectively adhere to the imaging member in an image-wise configuration, so as to provide a developed image. The developed image is typically transferred to a copy substrate. The residual toner, typically present in a background image, is usually removed in preparation for a subsequent imaging cycle. A simple blade cleaning apparatus may be employed; other cleaning devices may include a brush or roller member for removing toner from the surface on which it resides. The removed toner may be transported to a toner sump or other conservation vessel so that the waste toner can be reclaimed for subsequent use.

In accordance with one aspect of the present invention, there is provided a toner cleaning system for cleaning toner from a supporting surface. A movable member includes a carrier permeable segment featuring a porous structure. The movable member is employed to engage the supporting surface so as to receive therefrom the toner layer. The microporous structure includes pores slightly smaller than the particle size of the toner particles in the toner layer such that the toner layer may be temporarily supported on the movable member until removal therefrom is desired. A quantity of carrier fluid is provided at an inner surface of the carrier permeable segment. The porous structure allows carrier fluid to flow therethrough in response to an applied carrier fluid transport force so as to reduce or eliminate the bond between the toner layer and the exterior of the carrier permeable segment, thus forcing the toner layer to at least partially disengage from the exterior surface of the carrier permeable segment. The disengaged portion of the toner layer than falls away from the exterior surface of the carrier permeable segment, or is easily collected therefrom by suitable collection means. The toner and any carrier fluid thus removed from the carrier permeable segment may be collected and conserved for reuse, if desired.

Of particular interest with respect to the present invention is the electrostatographic printing process known as contact electrostatic printing, wherein a thin layer of liquid developing material is formed on a first surface of a first member, wherein the layer has a high concentration of charged toner, and is subjected to an electrostatic latent image. Development of the latent image than occurs wherein toner particle migration or electrophoresis is replaced by direct surface-to-surface transfer of a toner layer induced by image-wise fields. For the purposes of the present description, the concept of latent image development via direct surface-to-surface transfer of a toner layer via image-wise fields will be identified generally as contact electrostatic printing (CEP). Exemplary patents which may describe certain general aspects of contact electrostatic printing, as well as specific apparatus therefor, may be found in U.S. Pat. Nos. 4,504,138; 5,436,706; 5,596,396; 5,610,694; and 5,619,313.

Accordingly, and in another aspect of the present invention, there is provided an imaging system for effecting contact electrostatic printing of an image, wherein the imaging system includes at least one contact electrostatic printing engine operable upon a copy substrate. A toner cleaning system is operable in the printing engine. The printing engine includes a transport which moves a latent image bearing member along a path. A toner layer is brought into pressure contact with the latent image bearing surface of the latent image bearing member such that a developed image is created by separating and selectively transferring, portions of the toner layer in correspondence with the image and non-image regions of the latent image. A toner cleaning system is disposed adjacent to the latent image bearing surface. The toner cleaning system includes a movable member having a carrier permeable segment. The movable member is employed to engage the supporting surface so as to receive therefrom the toner layer, thereby cleaning the residual toner layer from the latent image bearing surface. Carrier fluid flow through the carrier permeable segment in response to an applied carrier fluid transport force reduces or eliminates the bond between the toner layer and the exterior of the carrier permeable segment, thus forcing the toner layer to at least partially disengage from the exterior surface of the carrier permeable segment.

In accordance with another aspect of the present invention, a toner cake delivery and cleaning apparatus may be constructed and operated in first and second modes, each of which are useful in the operation of the contact electrostatic printing process to which the present invention is directed. In a first mode of operation, for effecting toner cake delivery, a toner cake layer of high solids content is created on a carrier permeable segment of a coating member. To do so, a low solids content liquid developing material applicator provides a relatively uniform layer of low solids content liquid developing material onto the carrier permeable segment. The layer of low solids content liquid developing material is subject to a rapid adsorption of at least a portion of the carrier fluid away from the layer of liquid developing material. As a result, a reduction of the ratio of carrier fluid to toner solids in the liquid developing material layer results in the formation of the desired toner cake layer. The toner cake layer is then available for transfer to the surface of a receiving member for subsequent use in development of an electrostatic latent image. For example, the toner cake layer may undergo pressure contact with the surface of an imaging member which bears a latent image. A developed image is subsequently created by separating and selectively transferring portions of the toner cake layer to an image separator in correspondence with the image and non-image regions of the latent image. The developed image and non-image areas are separated at the exit of the process nip. Further rotation of the image separator allows the developed image to be transferred from the surface of the image separator to a copy substrate carried on a substrate transfer path.

In the second mode of operation, rotation, of the imaging member allows a toner layer, such as the portions of residual toner cake from the non-image areas, to be transferred to the carrier permeable segment. The carrier permeable segment is then subjected to a flow of carrier fluid to cause the toner layer to be detached from the carrier permeable segment for subsequent collection by toner collection means.

The foregoing and other aspects of the present invention will become apparent from the following description in conjunction with the accompanying drawings wherein like reference numerals have been used throughout to identify identical or similar elements.

FIG. 1 is a side sectional view of a portion of a basic embodiment of a novel toner cleaning system constructed to include a carrier permeable segment in a movable coating member, wherein the carrier permeable segment is constructed for receiving a toner layer thereon and for subsequently experiencing a controlled flow of carrier fluid, such that the toner layer is subject to disengagement from the carrier permeable segment, and for optional collection therefrom by suitable collection means.

Figure 4:
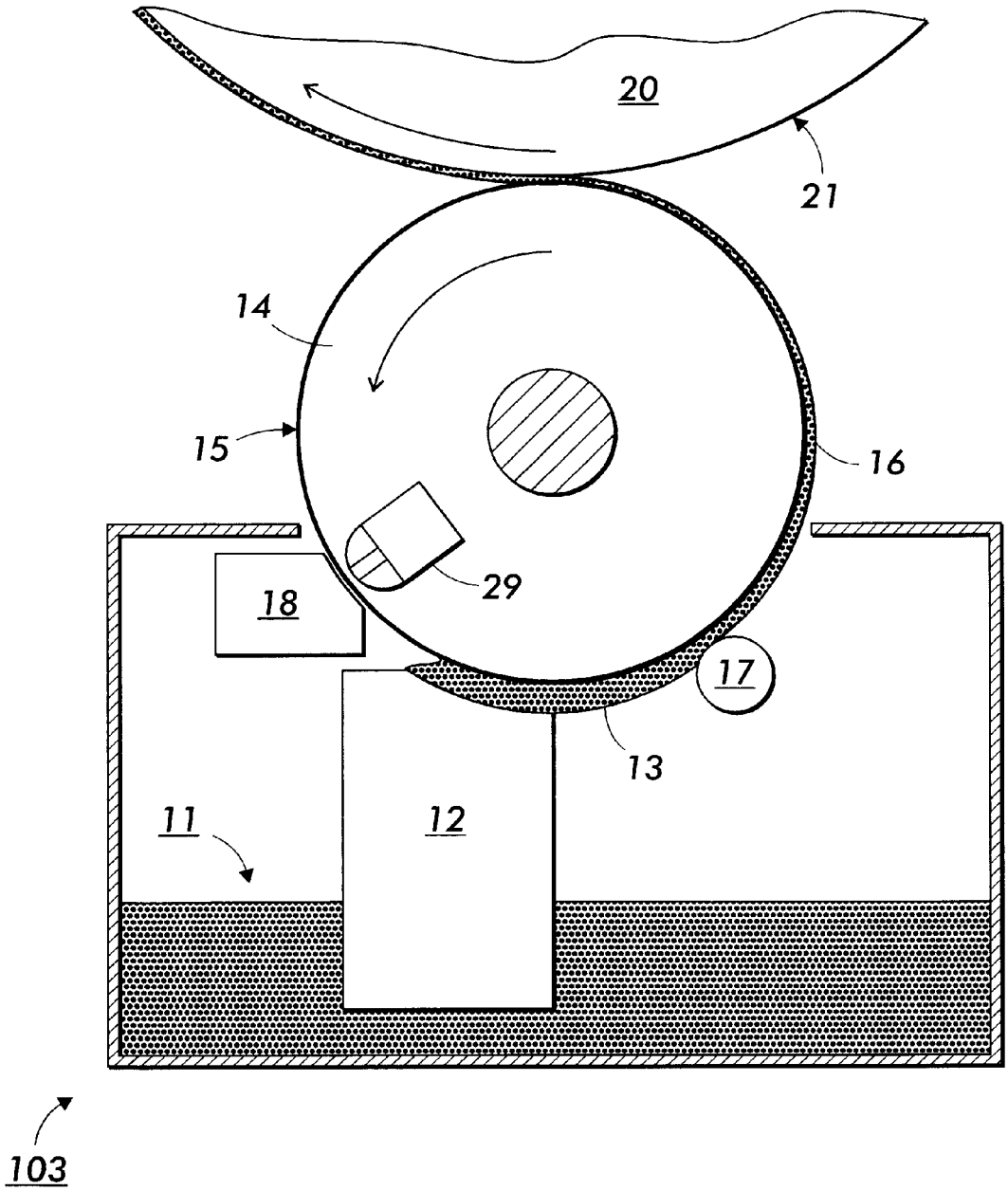
Figure 5:
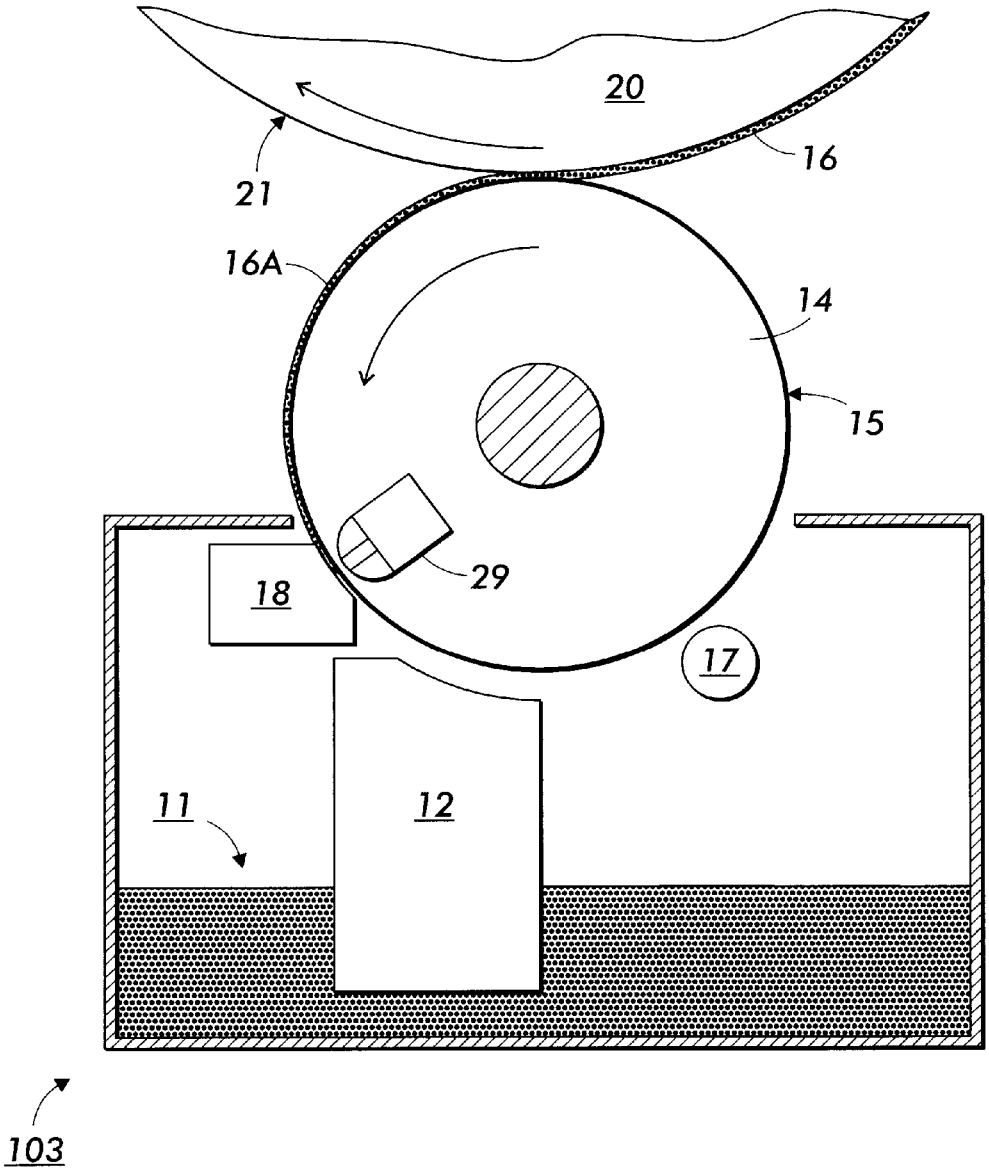

FIGS. 4 and 5 are simplified schematic representations of a preferred embodiment of a toner cake layer delivery and cleaning station constructed according to the present invention for use in a contact electrostatic printing system. The apparatus is shown in FIG. 4 in a first mode for delivery of a toner cake layer to a supporting surface for development of a latent image, and the apparatus is shown in FIG. 5 in a second mode for cleaning residual toner cake from the supporting surface.

Figure 6:
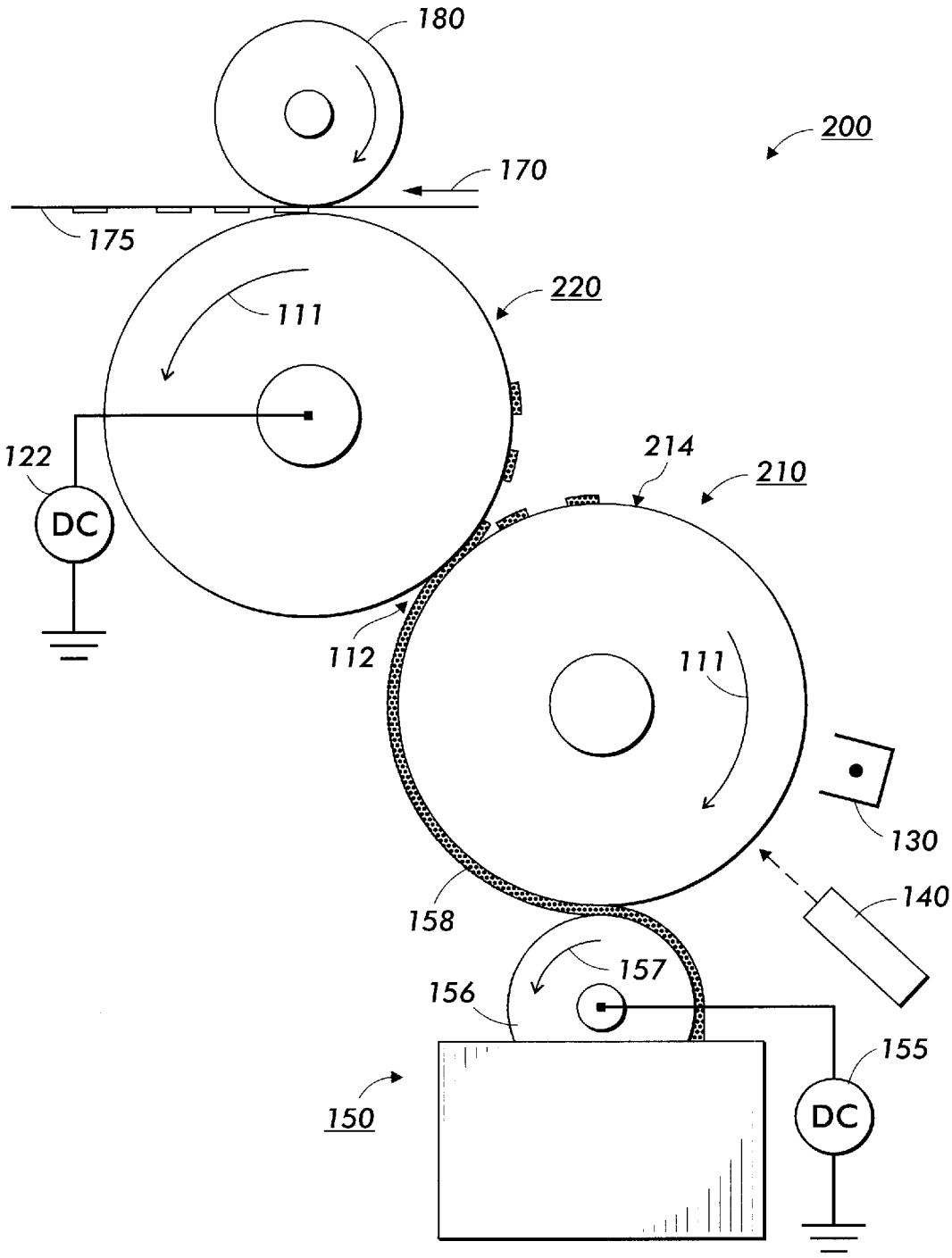

FIG. 6 is an elevational view schematically depicting a preferred embodiment of a contact electrostatic printing engine constructed for use in imaging and development of an electrostatic latent image.

Although the following description will describe, by example, several embodiments of a contact electrostatic printing engine, and related processes that incorporate a photosensitive imaging member, it will be understood that the present invention is useful in a variety of electrostatic and electrophotographic printing systems, and contemplates the use of various alternative imaging members as are well known in the art of electrostatographic printing, including, for example, but not limited to, non-photosensitive imaging members such as a dielectric charge retaining member of the type used in ionographic printing machines, or electroded substructures capable of generating charged latent images. Accordingly, certain embodiments of the present invention will be described with reference to an electrostatic imaging system wherein latent image development is carried out via direct surface-to-surface transfer of a toner cake layer, utilizing image-wise electrostatic forces to separate the toner cake layer into image and non-image regions, regardless of where the layer of toner cake is formed prior to image separation or how the image separating electrostatic forces are generated.

Description herein of "toner" is meant to include image marking particles in general. Description herein of a "toner layer" may be understood to include a simple aggregation or distribution of marking particles such as toner on a supporting surface; such particles may be present in small or large amounts, in uniform or non-uniform distributions, and in continuous or discontinuous arrangements, as experienced in the art.

A "toner cake layer" is specially defined herein. A toner cake layer is generally characterized as a toner layer having a high solids content (e.g., approximately 10–50 percent solids, and preferably in the range of approximately 15 to 35 percent solids, or greater), and exhibits the additional advantageous characteristics of a uniform thickness, in the range of 1–15 microns, and a uniformly metered mass per unit area in the range of approximately 0.03 to 0.2 mg per $cm^2$.

Exemplary toner colors are selectable as known in the art, e.g., cyan, magenta, yellow, and black; however, other component colors may be employed. Furthermore, the developing materials described herein may be distinguishable according to one or more physical characteristics in addition to, or other than, the color of the toner, and nonetheless such embodiments are encompassed by the present invention.

Accordingly, the various embodiments of the toner cleaning and reclamation systems described herein are useful in performing the tasks of cleaning and optional reclamation of toner particles, toner layers, or toner cake layers as specified herein.

For the purposes of description herein, a "carrier permeable segment" may be understood to include porous structures provided in a variety of configurations; preferred embodiments are illustrated in the form of a rotatable cylindrical shell and a movable flexible belt, the movement of which may be effected along a predefined path. These preferred embodiments of the carrier permeable segment allow carrier fluid flow at least in a direction between the interior and exterior major surfaces of the carrier permeable segment.

Flow of the carrier fluid within the carrier permeable segment will be considered herein to encompass, but not be limited to, capillary and sorbtive processes. For example, the process of "adsorption" involves separation of a substance from one phase accompanied by its accumulation or concentration at the surface of another. The adsorbing phase (i.e., the carrier permeable segment) is the adsorbent, and the material concentrated or adsorbed at the surface of that phase is the adsorbate (i.e., the carrier fluid.) Absorption is another process in which material transferred from one phase to another interpenetrates the second phase to form a "solution". The term sorption is a general expression encompassing both processes. A large specific surface area is preferable for providing large adsorption capacity; suitable materials include a large internal surface area in a limited volume, as are provided by large numbers of small sized pores between adsorption surfaces.

Passive flow of the carrier fluid, e.g., according to capillary action, may be enhanced by application of one or more additional separation mechanisms or influential factors, such as the application of thermal energy (e.g., radiant heating), gravity, or a pneumatic pressure differential.

Useful embodiments of the carrier permeable segment include, but are not limited to, one or more of the following:

(1) A porous structure having predetermined pore dimensions and which is predisposed to carrier fluid adsorption, absorption, or both. Some porous materials exhibit a capillary action which retains a substantial proportion of marking particles at or near the exterior of the carrier permeable segment. Examples include a microporous rubber or polymer layer, or a microporous or sintered ceramic layer.

(2) A porous structure, such as a fibrous, foamed, mesh, or open cellular matrix having interstitial voids capable of carrier fluid flow but generally blocking flow of the toner particles. Contemplated embodiments of such a structure will enable carrier fluid flow, especially when subjected to a pressure differential (e.g., a vacuum) or mechanical deformation (e.g., bending, compression, or constriction), so as to express the carrier fluid therethrough while accumulating at least a majority of the toner solids on a surface of the carrier permeable segment. Such structures may also exhibit the advantageous tendency, to a certain extent, for carrier fluid flow via absorption or capillary action.

(3) A porous structure having one or more layers exhibiting a selective physical, chemical, or electrochemical attraction, considered herein as a "selective affinity", for the carrier fluid in contrast to any such affinity for the toner particles. One example is silicone rubber.

(4) A combination of structures (1)–(3), above.

"Expression" of carrier fluid may be understood to describe carrier fluid flow from a quantity of carrier fluid retained on one surface of the carrier permeable segment to the interface of a toner particle or a toner layer present on the opposing surface of the carrier permeable segment.

"Separation" or "absorption" of carrier fluid, from a layer of liquid developing material located on one surface of the carrier permeable segment, may be understood to describe carrier fluid flow from the layer of liquid developing material into at least the body of the carrier permeable segment, and in some implementations, carrier fluid flow to the opposing surface of the carrier permeable segment.

"Flow" and "migration" are meant to be generally equivalent terms applicable to carrier fluid movement, and may be understood to occur either by controlled application of a motive force to affect carrier fluid movement, such as by a pneumatic pressure differential, or by passive implementation of a motive force, such as may be provided in the naturally-occurring capillary action observable in a microporous structure.

Certain embodiments of the present invention are described as including a supply of low solids content liquid developing material, which is generally made up of toner particles immersed in a liquid carrier medium and also typically including a charge director for providing a mechanism for producing an electro-chemical reaction in the liquid developing material composition which generates the desired electrical charge on the toner particles. Preferred embodiments of a toner cake layer may be derived from such a supply of low solids content liquid developing material.

The low solids content liquid developing material may be characterized as having a percentage of solids content that is less than, the percentage of solids content desired in a toner cake layer. For example, an approximately 1–10 percent solids content is considered to be characteristic of a low solids content liquid developing material; an approximately 10–50 percent solids content, or greater, and preferably on the order of approximately 15 to 35 percent solids, is considered to be characteristic of the toner cake layer. For the purposes of this description, the low solids content liquid developing material is generally characterized as having a solids content that is less than the solids content of the toner cake layer. The toner cake layer also preferably exhibits the additional advantageous characteristics of a uniform thickness, selectable from the range of approximately 1–15 microns, and a uniformly metered mass per unit area in the range of approximately 0.03 to 0.2 mg per $cm^2$.

The contact electrostatic printing process of the present invention preferably includes limited relative movement between toner particles during and after latent image development, wherein the high solids content of the toner cake layer prevents toner particles from moving relative to each other.

The contact electrostatic printing process of the present invention may include development of an electrostatic latent image on an image support using supply limited development techniques, i.e., the developing potential of the latent image is not typically exhausted after being initially developed.

Figure 1:
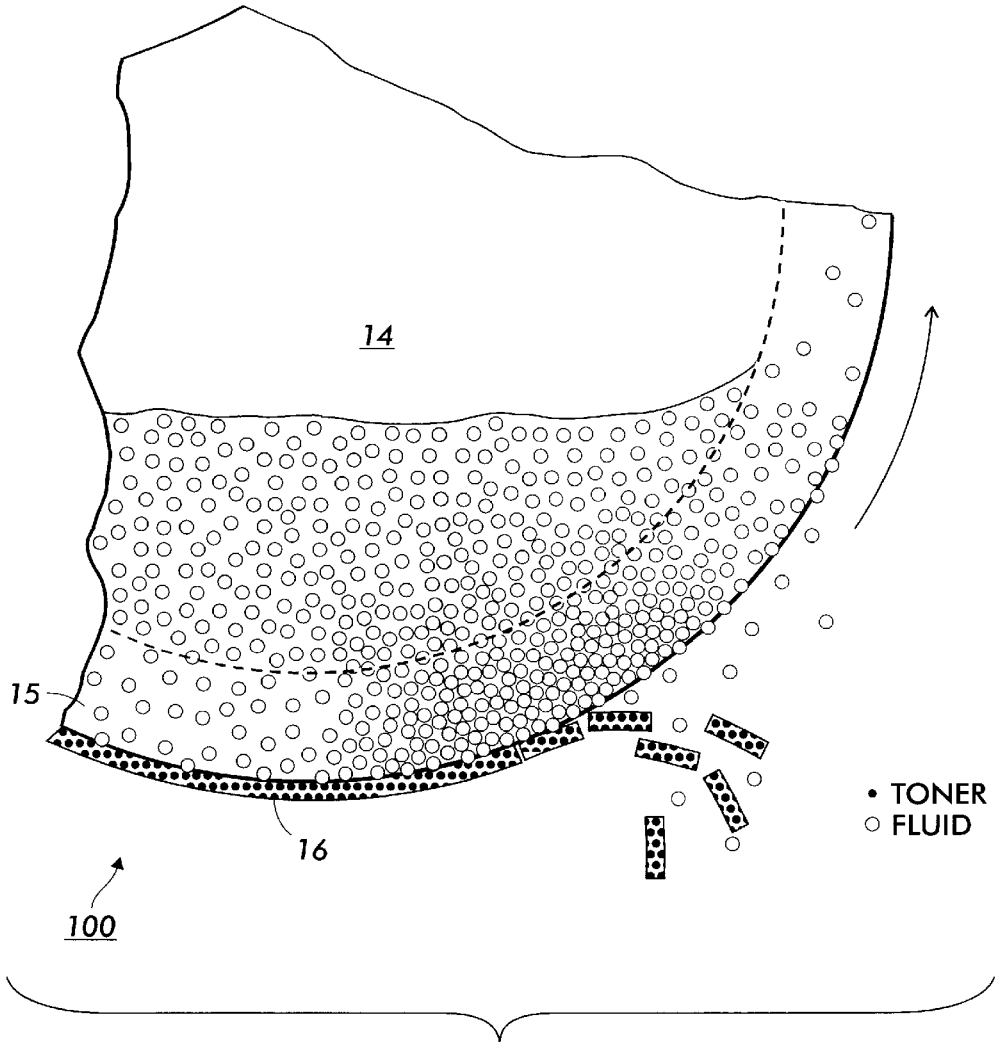

FIG. 1 is a simplified schematic representation of a basic embodiment 100 of a toner cleaning system constructed for operation according to the present invention, wherein a toner layer 16 may be situated on a carrier permeable segment 15 integrated in a movable coating member 14. Preferably, the carrier permeable segment 15 includes a porous structure having pores slightly smaller than the particle size of the toner particles in the toner layer 16 such that the toner layer 16 may be supported on the carrier permeable segment 15 until cleaning therefrom is desired. A source of carrier fluid is made available at a portion of the interior surface of the carrier permeable segment 15 that is to be subject to cleaning. In the exemplary embodiment, a quantity of carrier fluid is maintained within the interior of the coating member 14. When toner cleaning is to be performed, carrier fluid to flow into the porous structure of the carrier permeable segment 15 is implemented in response to a carrier fluid transport force suitable for causing the carrier fluid to flow to the interface of the toner layer 16 and the carrier permeable segment 15. Passive carrier fluid transport may be effected due to absorption, for example, and active or induced carrier fluid transport may be effected by any of a variety of applied forces including thermal, electrophoretic, gravitational, or pneumatic forces.

Accordingly, as illustrated in FIG. 1, at least a portion of the carrier fluid is subject to flow from the interior of the coating member 14 and through the carrier permeable segment 15 to arrive at the interface between the toner layer 16 and the exterior surface of the carrier permeable segment 15. The presence of carrier fluid at the interface is implemented so as to weaken the bond between the toner layer 16 and the exterior surface of the carrier permeable segment 15, thus forcing the toner layer 16 to at least partially disengage from the exterior surface of the carrier permeable segment 15. As illustrated, the toner layer 16 can then separate from the exterior surface of the carrier permeable segment 15 and fall away in fragments. Alternatively, the weakened bond of the toner layer 16 is easily broken, and toner is removed from the carrier permeable segment 15, by suitable mechanical means such as a brush or roller (not shown in FIG. 1). The separated toner layer fragments may collected for subsequent re-use.

Figure 2:
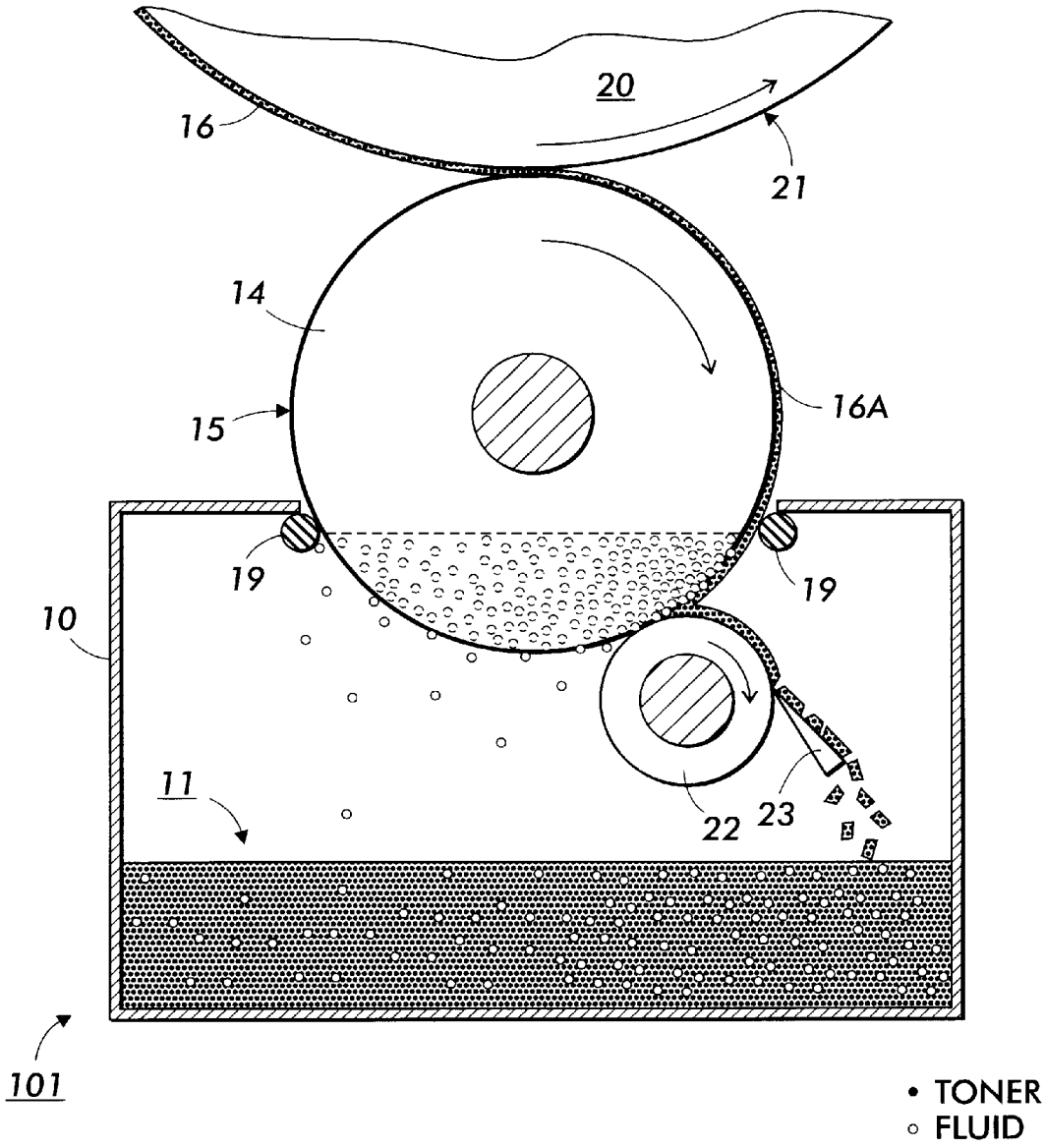
FIG. 2 is a simplified schematic representation of a first embodiment of a toner cleaning station constructed according to the present invention.

FIG. 2 illustrates a first embodiment 101 of a toner cleaning station operable in an electrostatic printing apparatus, wherein a first movable member 20 includes a supporting surface 21 having thereon a toner layer 16 which is to be subject to cleaning. The supporting surface 21 of the movable member 20 may have one of a variety of functions; for example, the supporting surface 21 may be a latent image bearing surface (as will be described below). The first movable member 20 is rotated into a transfer nip against a coating member 14 having a carrier permeable segment 15. The toner layer 16 is transferred from the supporting surface 21 to become toner layer 16A on the carrier permeable segment 15. The coating member 14 is supported for partial enclosure within a housing 10. Further rotation of the coating member 14 places the toner layer 16A into the enclosed portion of the housing 10. Expression of a portion of the carrier fluid from a reservoir of carrier fluid to the interface between the toner layer 16A and the carrier permeable segment 15 preferably begins as the toner layer 16A first enters the housing 10; such expression may be aided by application of one or more carrier fluid transport forces, such as by establishing a negative pressure about the portion of the carrier permeable segment 15 that is enclosed by the housing 10 and suitable pressure seals 19. Disengagement of the toner layer 16A then ensues due to the presence of the carrier fluid at the interface between the toner layer 16A and the carrier permeable segment 15. Continued rotation of the coating member 14 places the disengaged portion of the toner layer 16A against a wiping transfer roll 22, whereupon the disengaged portion of the toner layer 16A is efficiently removed from the carrier permeable segment 15. A blade 23 causes the fragments of toner layer 16A to be directed from the wiping transfer roll 22 into the supply 11. Conservation of some or all of the toner layer 16A is thus contemplated for subsequent provision to a supply 11. Carrier fluid that is completely expressed from the carrier permeable segment 15 may also weep or condense into the supply 11 and thus is conserved. Continuous rotation of the coating member 14 thereby affords efficient and methodical cleaning of the toner layer 16 from the supporting surface 21.

Figure 3:
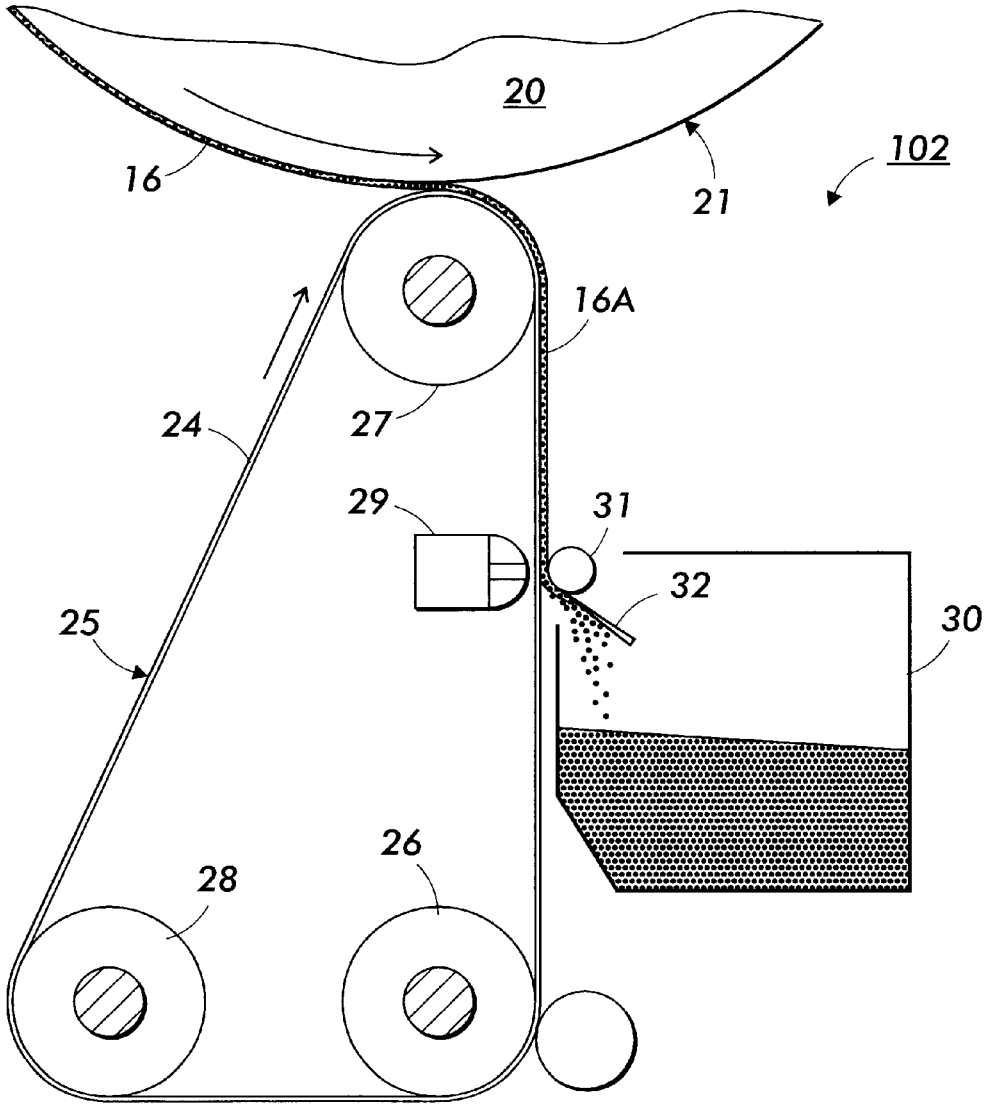
FIG. 3 is a simplified schematic representation of second embodiment of a toner cleaning station constructed according to the present invention.

FIG. 3 illustrates a second embodiment, 102 of a toner cleaning station operable in an electrostatic printing apparatus. One may appreciate that, although the coating member 14 of FIG. 1 is shown and described herein in the form of a drum, the coating member 14 may alternatively be provided in other forms, such as in the form of a continuous flexible belt 24 having a carrier permeable segment 25 integrated therein. The belt 24 is entrained over a series of rollers 26, 27, 28, and is movable in a process direction to engage the first movable member 20. A collection unit 30 (including a wiping transfer roll 31 and blade 32) and a carrier fluid supply device 29 are respectively operable at the exterior and the interior of the carrier permeable segment 25. The carrier fluid supply device 29 induces carrier fluid flow to interface of the toner layer 16A by, for example, heated or pressurized expression of a quantity of carrier fluid into the carrier permeable segment surface 25.

FIGS. 4 and 5 illustrate a preferred embodiment 103 of a toner cake delivery and cleaning station operable in an electrostatic printing apparatus. The illustrated embodiment 103 is operable in a first mode for effecting toner cake delivery, and in a second mode for affecting toner cleaning. The toner cake layer delivery mode operable in the illustrated embodiment 103 is disclosed in commonly-assigned U.S. Pat. No. 6,256,468, issued in the name of Chu-Heng Liu on Jul. 3, 2001, the disclosure of which is included herein by reference.

FIG. 4 illustrates the embodiment 103 operating in the mode for performing toner cake delivery. The system includes a supply 11 of low solids content liquid developing material from which a liquid developing material applicator 12 obtains a sufficient amount of low solids content liquid developing material to apply a layer 13 of liquid developing material onto the carrier permeable segment 15. In the first mode, application of the liquid developing material layer 13 and concurrent rotation of the coating member 14 causes the liquid developing material layer 13 to be subject to rapid migration of a selectable proportion of the carrier fluid from the liquid developing material layer 13 into the carrier permeable segment 15. The liquid developing material layer 13 thus becomes a high solids content layer in the form of the desired toner cake layer 16. The desired toner cake inlayer 16 exhibits a solids content percentage level that is higher than the solids content percentage level that is originally exhibited by the liquid developing material layer 13. The toner cake layer 16 may then be transferred to the supporting surface 21 of the movable member 20. Continuous rotation of the coating member 14 and migration of the carrier fluid into the carrier permeable segment 15 allows for uninterrupted formation of the toner cake layer 16.

A variety of devices may be utilized as the, applicator 12 for applying the liquid developing material layer 13 to the surface of the coating member 14, such as, but not limited to, known systems directed toward the transportation of liquid developing material having toner particles immersed in a carrier liquid, including various apparatus used in conventional lithographic printing applications as well as traditional liquid electrostatographic applications. For example, the applicator 12 can include a fountain-type device as disclosed generally in commonly assigned U.S. Pat. No. 5,519,473 (incorporated by reference herein). A reverse roll member may also be provided, wherein the function of the reverse roll member can be two-fold: for metering a portion of the liquid carrier away from the liquid developing material as it is applied to the surface of the coating member 14; and/or for electrostatically pushing (via a suitable biasing source, not shown) the liquid developing material toward the surface of the coating member 14. Additionally embodiments of the applicator 12 include the following: a slot die, an extrusion member, a slide, a liquid developing material curtain, a gravure roll, a forward roll, a squeegee roll, a blade apparatus, a foam roller or belt, a wired rod, a screen coater, or a shoe.

If the liquid developing material layer 13 is supplied by the supply 11 in a charged state, the coating member 14 can be biased using known devices to enhance or control the quality of the low solids content liquid developing material layer 13. If the liquid developing material layer 13 is supplied by the supply 11 in a neutral (uncharged) state, the layer concentrator 15 preferably includes a charging section to charge the layer 13 prior to its transformation to the toner cake layer 16. Chemical charging or corona charging devices, as known in the art, may be utilized.

The embodiment 103 may optionally include a roll 17, which, depending on its position with respect to the carrier permeable segment 15, may be operated to: (1) act as a metering roller to effect a selectively metered thickness for the liquid developing material layer 13; (2) compress the liquid developing material layer 13 into the carrier permeable segment 15 to enhance absorption of the carrier fluid; or (3) when sufficiently impressed against the carrier permeable segment 15 as to deform the surface, separation of the carrier fluid through the carrier permeable segment 15 into the interior of the coating member 14 may occur. A vacuum within the interior of the coating member 14 may additionally be employed to assist such carrier fluid separation through the carrier permeable segment 15 for subsequent collection and/or removal from the interior of the coating member 14.

For example, the roll 17, when situated in close proximity to the carrier permeable segment surface 15, provides a shear force against the low solids content material layer 13 deposited on the surface thereof, thereby controlling the thickness of the low solids content developing material layer. The excess material eventually falls away from the metering roll and may be transported to the supply 11 for reuse.

FIG. 5 illustrates the embodiment 103 operating in the mode for performing toner cake cleaning, wherein rotation of the coating member 14 may be actuated to transfer the toner cake layer 16 to the carrier permeable segment 15 for subsequent removal from the coating member 14. The carrier fluid supply device 29 and a toner cake layer collection unit 18 are operated to affect, for example, thermal or pressurized transport of the carrier fluid into the carrier permeable segment 15. The toner cake layer 16A disengages from the carrier permeable segment 15 and the toner cake layer fragments and any carrier fluid may be reclaimed by the collection unit 18 for subsequent provision to the supply 11.

FIG. 6 is an elevational view schematically depicting an embodiment of contact electrostatic printing (CEP) engine 200 constructed for imaging and development of a component electrostatic latent image, with advantageous use of the preferred embodiment 103 of a toner cake delivery and cleaning system illustrated FIGS. 4 and 5. The illustrated engine 200 includes an embodiment 150 of a toner cake delivery and cleaning station, which, for simplicity, is shown as operating in its toner cake layer delivery mode.

The illustrated CEP engine 200 is adapted for operation with respect to a copy substrate 175 carried on a substrate transfer path 170. The engine 200 is preferably associated with a respective pressure roller 180 for establishing at least a basic contact transfer, electrostatic transfer, or transfixing of the developed image to the copy substrate 175. An optional fuser assembly (not shown) may be provided for full or final fusing of the developed image when necessary.

The CEP engine 200 comprises a first movable member in the form of an imaging member 210 that includes an imaging surface of any type capable of having an electrostatic latent image formed thereon. The exemplary imaging member 210 may include a typical photoconductor or other photoreceptive component of the type known to those of skill in the art of electrophotography, wherein a surface layer having photoconductive properties is supported on a conductive support substrate.

Imaging member 110 is rotated so as to transport the surfaces thereof in a process direction 111 for implementing a series of image forming steps. It will be understood that, while imaging member 110 is shown and described herein in the form of a drum, the imaging member may alternatively be provided in the form of a continuous flexible belt which is entrained over a series of rollers, and is movable in the same direction as shown.

Initially, in the exemplary embodiment of FIG. 6, the photoconductive surface 214 of imaging member 210 passes through a charging station, which may include a corona generating device 130 or any other charging apparatus for applying an electrostatic charge to the surface of the imaging member 110. The corona generating device 130 is provided for charging the photoconductive surface 214 of imaging member 210 to a relatively high, substantially uniform electrical charge potential. It will be understood that various charging devices, such as charge rollers, charge brushes and the like, as well as inductive and semiconductive charge devices, among other devices which are well known in the art, may be utilized at the charging station for applying a charge potential to the surface 214 of the photosensitive imaging member 210.

After the imaging member 210 is brought to a substantially uniform charge potential, the charged surface thereof is advanced to an image exposure station, identified generally by reference numeral 140. The image exposure station projects a light image, corresponding to the desired component image, onto the charged photoconductive surface. In the case of an imaging system having a photosensitive imaging member 210, the light image projected onto the surface of the imaging member 210 selectively dissipates the charge thereon for recording an electrostatic latent image on the photoconductive surface 214, wherein the electrostatic latent image comprises, in image configuration corresponding to the input image information, image areas defined by a first charge voltage potential and non-image areas defined by a second charge voltage potential. The image exposure station 140 may incorporate various optical image projection and formation components as are known in the art, and may include various well known light lens apparatus or digital scanning systems for forming and projecting an image from an original input document onto the imaging member 210. Alternatively, various other electronic devices available in the art may be utilized for generating electronic information to create the electrostatic latent image on the imaging member. It will be understood that the electrostatic latent image may be comprised of image and non-image areas that are defined by regions having opposite charge polarities or by regions having distinguishable first and second voltage potentials which are of the same charge polarity.

The coating member 156 is rotated in a direction as indicated by arrow 157 for transporting the toner cake layer 158 onto the surface of the imaging member 210. An electrical biasing source 155 may be coupled to the coating member 156 to assist in electrostatically moving the toner particles onto the surface 214.

After the toner cake layer 158 is formed on the surface 214, the toner cake layer 158 is brought into a process nip 112 formed by the operative engagement of a image separator 220 and the imaging member 210. Imagewise electric fields across the layer of toner cake are generated in the process nip. The process nip is defined by a nip entrance and a nip exit, wherein the process nip and the nip entrance are operative to apply compressive stress forces on the layer of toner cake thereat, and the nip exit is operative to apply tensile stress forces to the layer of toner cake, causing imagewise separation of the layer of toner cake corresponding to the electrostatic latent image. The layer of toner cake is defined by a yield stress threshold in a range sufficient to allow the layer of toner cake to behave substantially as a solid at the nip entrance and in the nip, while allowing the layer of toner cake along the image-background boundary to behave substantially as a liquid at the nip exit. In order to optimize the resultant image quality, it is desirable that the toner cake layer have sufficient yield stress to allow the toner particles therein to maintain their integrity while being exposed to these particular stress forces.

One objective of the engine 200 illustrated in FIG. 6 is to place the toner cake layer 158 under pressure in the process nip 112; accordingly, it may desirable to provide either the image separator 220 or the imaging member 110 in the form of a conformable member for permitting the surface of one member to correspond in form or character to the opposing surface in the nip region.

It will be understood that the presence of lithe latent image on the imaging member 110 may generate some fringe fields in areas of interface between image and non-image areas of the latent image. However, compared to conventional development, the illustrated embodiment will substantially eliminate fringe field related image defects due to the solid-like property of the toner cake layer 158 at the entrance of the nip.

An electrical biasing source 122 applies an electrical bias so as to generate fields in opposite directions, either toward the surface of the imaging member 210 or towards the surface of the image separator 220 in accordance with image and non-image portions of the latent image. Moreover, these fields cause the separation of the image and non-image areas of the toner cake layer 158 upon separation of the imaging member 110 and the image separator 220 at the nip exit for simultaneously separating and developing the toner cake layer 158 into image and non-image portions on the opposed surfaces of the imaging member 110 and the image separator 220.

In the illustrated embodiment, the image separator 220 is provided with an electrical bias appropriate for attracting image areas while repelling non-image areas toward the imaging member 210, thereby maintaining toner portions corresponding to image areas on the surface of the image separator 220, yielding a developed image on the image separator 220. (Alternatively, the image separator 220 may be biased so as to repel image areas, thereby producing a developed image made up of selectively separated and transferred portions of the toner cake layer 158 on the surface of the imaging member 210, while leaving background image byproduct on the surface of the image separator 220. In such an instance, transfer of the developed image from the imaging member 210 to a suitable copy substrate may be accomplished with use of suitable transfer means, not shown.)

The developed image and background are separated at the exit of the process nip 112. After the developed image is formed on the surface of the imaging separator 220, the developed image may then be transferred to a copy substrate. In the illustrated embodiment, the developed image is transferred from the surface of the imaging separator 220 to the copy substrate 175 carried on the transfer path 170.

As was described with reference to FIG. 5, the embodiment 150 of the toner cake delivery and cleaning station may then be operated in the mode for performing toner cake cleaning, wherein the coating member 156 may be actuated to engage the imaging member 210 to receive residual portions of the toner cake layer 158 from the imaging member 210 to the coating member 156 for subsequent collection.

Additional details of the construction and operation of the illustrated embodiment 200 of the CEP engine and variations thereof may be found in commonly-assigned U.S. Pat. No. 5,826,147, the disclosure of which is incorporated herein by reference.

The carrier fluid and the liquid carrier medium utilized in the low solids content developing material may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and N, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe. These particular hydrocarbons may also possess a sufficiently high vapor pressure so that a thin film of the liquid evaporates from the contacting surface within seconds at ambient temperatures.

The toner solids or so-called marking particles can comprise any particulate material that is compatible with the liquid carrier medium, such as those contained in the liquid developing materials disclosed in, for example, U.S. Pat. Nos. 3,729,419; 3,841,893; 3,968,044; 4,476,210; 4,707,429; 4,762,764; 4,794,651; and 5,451,483, among others. Preferably, the toner particles should have an average particle diameter ranging from about 0.2 to about 10 microns, and most preferably between about 0.5 and about 2 microns. The toner particles can consist solely of pigment particles, or may comprise a resin and a pigment; a resin and a dye; or a resin, a pigment, and a dye or resin alone.

Suitable resins include poly(ethyl acrylate-co-vinyl pyrrolidone), poly(N-vinyl-2-pyrrolidone), and the like, including, for example Elvax®, and/or Nucrel®, available from E. I. DuPont de Nemours & Co. of Wilmington, Del. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers; as well as the numerous pigments listed and illustrated in U.S. Pat. Nos. 5,223,368; 5,484,670, the disclosures of which are totally incorporated herein by reference. Dyes generally are present in an amount of from about 5 to about 30 percent by weight of the toner particle, although other amounts may be present provided that the objectives of the present invention are achieved.

Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF); as well as the numerous pigments listed and illustrated in U.S. Pat. Nos. 5,223,368; 5,484,670, the disclosures of which are incorporated herein by reference. Generally, any pigment material is suitable provided that it consists of small particles that combine well with any polymeric material also included in the developer composition. Pigment particles are generally present in amounts of from about 5 to about 60 percent by weight of the toner particles, and preferably from about 10 to about 30 percent by weight.

As previously indicated, in addition to the carrier fluid and toner particles which typically make up the liquid developer materials, a charge director (sometimes referred to as a charge control additive) is also provided for facilitating and maintaining a uniform charge on the marking particles in the operative solution of the liquid developing material by imparting an electrical charge of selected polarity (positive or negative) to the marking particles. Examples of suitable charge director compounds include lecithin, available from Fisher Inc.; OLOA 1200, a polyisobutylene succinimide, available from Chevron Chemical Company, basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight of solids, and preferably from about 0.02 to about 0.05 percent by weight of solids of the developer composition.

What is claimed is:

1. A toner cleaning system for cleaning a toner from a supporting surface, comprising:

a movable member including a carrier permeable segment having interior and exterior surfaces and a porous structure therebetween, the movable member being located to engage the supporting surface so as to receive therefrom the toner onto the exterior surface; and a supply of carrier fluid provided at the interior surface of the carrier permeable segment;

wherein the carrier permeable segment enables carrier fluid flow from the supply of carrier fluid to a portion of the received toner so as to disengage the portion of the received toner from the carrier permeable segment.

2. The toner cleaning system of claim 1, further comprising means for application of a carrier fluid transport force so as to induce selectable flow of an amount of carrier fluid from the supply of carrier fluid to the portion of the received toner.

3. The toner cleaning system of claim 2, wherein the means for application of a carrier fluid transport force further comprises a structure surrounding the portion of received toner layer, wherein a pressure differential is established between the supply of carrier fluid and the portion of the received toner.

4. The toner cleaning system of claim 2, wherein the means for application of a carrier fluid transport force further comprises a carrier fluid supply device.

5. The toner cleaning system of claim 1, wherein the movable member is provided in the form of a drum.

6. The toner cleaning system of claim 1, wherein the movable member is provided in the form of a belt.

7. The toner cleaning system of claim 1, wherein the carrier permeable segment further comprises a porous structure exhibiting at least one of the following characteristics: having predetermined pore dimensions predisposed to carrier fluid adsorption, absorption, or both; having interstitial voids capable of carrier fluid flow but generally blocking flow of toner particles; having one or more layers exhibiting a selective affinity for the carrier fluid in contrast to the toner particles; and having pores slightly smaller than the particle size of the toner particles in the toner layer.

8. The toner cleaning system of claim 1, further comprising a collection unit for collection of at least a portion of: the received toner portion subject to disengagement, and the carrier fluid subject to flow.

9. The toner cleaning system of claim 1, wherein the carrier fluid further comprises a hydrocarbon liquid.

10. A toner cake layer delivery and cleaning apparatus operable, in a first mode, for delivery of a toner cake layer having a high solids content to a receiving member surface on a receiving member, and in a second mode, for cleaning of a toner cake layer from the receiving member surface, comprising:

a supply of liquid developing material, the liquid developing material being a mixture of toner in a carrier fluid, the mixture exhibiting a percentage level of solids content that is less than the percentage level of solids content in the desired toner cake layer;

a liquid developing material applicator connected to the supply of liquid developing material and operable for receiving a quantity of liquid developing material and for providing therefrom a layer of liquid developing material;

a supply of carrier fluid;

a movable coating member aligned with the liquid developing material applicator and the receiving member, the coating member having a carrier permeable segment for receiving, in the first mode of operation, the layer of liquid developing material at an exterior surface thereof, and in the second mode of operation, a quantity of carrier fluid at an interior surface from the carrier fluid supply;

wherein the coating member is operable:

(a) in the first mode, for separating at least a portion of the carrier fluid present in the layer of liquid developing material so as to increase the percentage level of solids content in the layer of liquid developing material, thus providing the desired toner cake layer, and wherein the coating member is movable for transporting the resulting toner cake layer into engagement with the receiving member surface for subsequent delivery of at least a portion of the toner cake layer to the receiving member surface; and (b) in the second mode, for engaging the receiving member to receive transfer of at least a portion of residual toner cake from the receiving member surface, and for inducing carrier fluid flow therein to cause the portion of residual toner cake to be detached from the carrier permeable segment for subsequent collection.

11. The apparatus of claim 10, further comprising means for application of a carrier fluid transport force so as to induce carrier fluid flow through the carrier permeable segment to the portion of residual toner cake.

12. The apparatus of claim 10, wherein the liquid developing material is characterized as having percentage level of solids content in the range of less than approximately 10 percent solids content.

13. The apparatus of claim 10, wherein the toner cake layer is characterized as having at least one of the following characteristics: a percentage level of solids content of approximately 10 percent solids content or greater; a thickness in the range of 1 to 15 microns; and a uniformly metered mass per unit area in the range of approximately 0.03 to 0.2 mg per $cm^2$.

14. The apparatus of claim 10, wherein the carrier permeable segment further comprises a porous structure exhibiting at least one of the following characteristics: having predetermined pore dimensions predisposed to carrier fluid adsorption, absorption, or both; having interstitial voids capable of carrier fluid flow but generally blocking flow of toner particles; and having one or more layers exhibiting a selective affinity for the carrier fluid in contrast to the toner particles.

15. The apparatus of claim 10, wherein the carrier permeable segment further comprises a porous structure having pores slightly smaller than the particle size of the toner particles in the toner layer.

16. The apparatus of claim 10, further comprising a collection means for collection of at least one of the residual toner cake and the carrier fluid.

17. An imaging system for effecting electrostatic printing of an output image, comprising:

an imaging assembly having an imaging member, the imaging member having an image bearing surface for receiving an electrostatic latent image thereon, the electrostatic latent image being representative of the desired output image;

a development assembly for developing the electrostatic latent image, the development assembly including a receiving member having a receiving member surface for receiving a layer of toner and engaging the electrostatic latent image on the image bearing surface for development of the electrostatic latent image into a developed image representative of the output image; and a toner cleaning system for cleaning a toner layer from at least one of the receiving member surface and the image bearing surface, comprising:

a movable member including a carrier permeable segment having a porous structure, the movable member being located to engage the at least one of the receiving member surface and the image bearing surface, so as to receive therefrom the toner layer at an exterior surface of the carrier permeable segment; and a supply of carrier fluid provided at an interior surface of the carrier permeable segment;

wherein the carrier permeable segment supports carrier fluid flow from the supply of carrier fluid to a portion of the received toner layer so as to disengage a portion of the received toner layer from the carrier permeable segment.

18. The imaging system of claim 17, further comprising:

a toner cake layer delivery apparatus operable for delivery of a toner cake layer to the receiving member surface on the receiving member, the toner cake layer delivery apparatus having:

(a) a supply of liquid developing material, the liquid developing material being a mixture of toner in a liquid carrier medium, the mixture exhibiting a percentage level of solids content that is less than the percentage level of solids content in the toner cake layer;

(b) a liquid developing material applicator connected to the supply of liquid developing material and operable for receiving a quantity of the liquid developing material and for providing therefrom a layer of liquid developing material;

(c) a movable coating member aligned with the liquid developing material applicator and the receiving member, the coating, member having a carrier permeable segment for receiving thereon the layer of liquid developing material, wherein the carrier permeable segment is operable for separating at least a portion of the liquid carrier medium present in the layer of liquid developing material so as to increase the percentage level of solids content in the layer of liquid developing material, thus providing the desired toner cake layer, the coating member being movable for transporting the resulting toner cake layer into engagement with the receiving member surface for subsequent delivery of at least a portion of the toner cake layer to the receiving member surface.

19. The imaging system of claim 17, wherein the image bearing surface includes a photosensitive imaging substrate.

20. The imaging system of claim 17, wherein the toner cake layer is characterized as having at least one of the following characteristics: a percentage level of solids content of approximately 10 percent solids content or greater; a thickness in the range of 1 to 15 microns; and a uniformly metered mass per unit area in the range of approximately 0.03 to 0.2 mg per $cm^2$.

21. The imaging system of claim 17, wherein the carrier permeable segment further comprises a porous structure exhibiting at least one of the following characteristics: having predetermined pore dimensions predisposed to carrier fluid adsorption, absorption, or both; having interstitial voids capable of carrier fluid flow but generally blocking flow of toner particles; having one or more layers exhibiting a selective affinity for the carrier fluid in contrast to the toner particles; and having pores slightly smaller than the particle size of the toner particles in the toner layer.

22. A method for cleaning a toner from a supporting surface, comprising the steps of:

providing a movable member including a carrier permeable segment having interior and exterior surfaces and a porous structure therebetween;

engaging the movable member with the supporting surface so as to receive the toner onto the exterior surface; and providing a supply of carrier fluid at the interior surface of the carrier permeable segment;

wherein the carrier permeable segment enables carrier fluid flow from the supply of carrier fluid to a portion of the received toner so as to disengage the portion of the received toner from the carrier permeable segment.

* * * * *